US008193141B2

(12) United States Patent
Corona, III et al.

(10) Patent No.: US 8,193,141 B2
(45) Date of Patent: Jun. 5, 2012

(54) FABRIC CARE COMPOSITIONS, PROCESS OF MAKING, AND METHOD OF USE COMPRISING PRIMARY PARTICLES COMPRISING CATIONIC POLYMER AND ANIONIC SURFACTANTS

(75) Inventors: Alessandro Corona, III, Mason, OH (US); Brian W. Everingham, Cincinnati, OH (US); Gayle Marie Frankenbach, Cincinnati, OH (US); Rajan Keshav Panandiker, West Chester, OH (US); Beth Ann Schubert, Maineville, OH (US); Mark Robert Sivik, Mason, OH (US); Kerry Andrew Vetter, Cincinnati, OH (US); Gregory Thomas Waning, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 148 days.

(21) Appl. No.: 12/549,418

(22) Filed: Aug. 28, 2009

(65) Prior Publication Data

US 2010/0056419 A1 Mar. 4, 2010

Related U.S. Application Data

(60) Provisional application No. 61/092,633, filed on Aug. 28, 2008, provisional application No. 61/221,632, filed on Jun. 30, 2009.

(51) Int. Cl.
*C11D 3/37* (2006.01)
*C11D 1/02* (2006.01)
*C11D 9/26* (2006.01)

(52) U.S. Cl. ..... 510/298; 510/349; 510/445; 510/475; 510/492; 510/504

(58) Field of Classification Search ..... 510/298, 510/349, 445, 475, 492, 504
See application file for complete search history.

(56) References Cited

U.S. PATENT DOCUMENTS

| | | | |
|---|---|---|---|
| 3,549,546 | A | 12/1970 | Moore |
| 3,943,255 | A | 3/1976 | Newkirk |
| 4,622,161 | A | 11/1986 | Cornelissens et al. |
| 4,634,544 | A | 1/1987 | Weber et al. |
| 4,806,522 | A | 2/1989 | Sprecker |
| 5,476,660 | A | 12/1995 | Somasundaran et al. |
| 5,529,696 | A | 6/1996 | Tibbitts |
| 5,573,709 | A | 11/1996 | Wells |
| 5,814,596 | A | 9/1998 | Aouad et al. |
| 5,904,735 | A | 5/1999 | Gutierrez et al. |
| 5,955,415 | A | 9/1999 | Gutierrez et al. |
| 6,156,720 | A | 12/2000 | Boeckh et al. |
| 6,255,271 | B1 | 7/2001 | Carswell et al. |
| 6,277,810 | B2 | 8/2001 | Baines et al. |
| 6,300,304 | B1 | 10/2001 | Boeckh et al. |
| 6,569,823 | B2 | 5/2003 | Mooney |
| 6,573,229 | B2 | 6/2003 | Creeth et al. |
| 6,576,228 | B1 | 6/2003 | Crookham et al. |
| 6,620,209 | B2 | 9/2003 | Kischkel et al. |
| 6,740,633 | B2 | 5/2004 | Nörenberg et al. |
| 6,846,797 | B1 | 1/2005 | Parker |
| 6,894,017 | B2 | 5/2005 | Brouwn et al. |
| 6,903,064 | B1 | 6/2005 | Kasturi et al. |
| 6,908,490 | B2 | 6/2005 | Boeckh et al. |
| 6,949,498 | B2 | 9/2005 | Murphy et al. |
| 7,012,054 | B2 | 3/2006 | Binder et al. |
| 7,074,750 | B2 | 7/2006 | Hamers et al. |
| 7,091,167 | B2 | 8/2006 | Lang et al. |
| 7,141,077 | B2 | 11/2006 | Detering et al. |
| 7,304,026 | B2 | 12/2007 | Heibel et al. |
| 2001/0034316 | A1 | 10/2001 | Carswell et al. |
| 2001/0051142 | A1 | 12/2001 | Duden et al. |
| 2002/0010121 | A1 | 1/2002 | Van Deurzen et al. |
| 2002/0010124 | A1 | 1/2002 | Creeth et al. |
| 2002/0055451 | A1 | 5/2002 | Kischkel et al. |
| 2002/0058604 | A1 | 5/2002 | Kischkel et al. |
| 2003/0104964 | A1 | 6/2003 | Cooper et al. |
| 2003/0109400 | A1 | 6/2003 | Murphy et al. |
| 2003/0192130 | A1 | 10/2003 | Kaaret et al. |
| 2004/0023836 | A1 | 2/2004 | Moorfield et al. |
| 2004/0033924 | A1 | 2/2004 | Murphy et al. |
| 2004/0063597 | A1 | 4/2004 | Adair et al. |
| 2004/0071742 | A1 | 4/2004 | Popplewell et al. |
| 2004/0071746 | A1 | 4/2004 | Popplewell et al. |
| 2004/0092425 | A1* | 5/2004 | Boutique et al. ..... 510/466 |
| 2004/0139559 | A1 | 7/2004 | Detering et al. |
| 2004/0152616 | A1 | 8/2004 | Murphy et al. |
| 2004/0152617 | A1* | 8/2004 | Murphy et al. ..... 510/475 |
| 2005/0028293 | A1 | 2/2005 | Geffroy |
| 2005/0097678 | A1 | 5/2005 | Geffroy |
| 2005/0101505 | A1 | 5/2005 | Wood |

(Continued)

FOREIGN PATENT DOCUMENTS

| | | |
|---|---|---|
| CA | 2 177 125 | 12/1996 |

(Continued)

OTHER PUBLICATIONS

International Search Report for PCT/US2009/054822 mailed Dec. 3, 2009, 6 pages.

International Search Report for PCT/US2009/054716 mailed Nov. 18, 2009, 4 pages.

International Search Report for PCT/US2009/061424 mailed Feb. 5, 2010, 4 pages.

International Search Report for PCT/US2009/061425 mailed Apr. 7, 2010, 4 pages.

(Continued)

*Primary Examiner* — Brian P Mruk

(74) *Attorney, Agent, or Firm* — Melissa G Krasovec; Andrew Mueller; Leonard W Lewis

(57) ABSTRACT

The instant disclosure relates to stable color maintenance and/or rejuvenation compositions comprising at least one cationic polymer and anionic surfactant, and methods for providing the same.

19 Claims, No Drawings

U.S. PATENT DOCUMENTS

| | | | | |
|---|---|---|---|---|
| 2005/0153865 | A1 | 7/2005 | Detering et al. | |
| 2005/0158489 | A1 | 7/2005 | Nagata et al. | |
| 2005/0159330 | A1 | 7/2005 | Shah et al. | |
| 2005/0166333 | A1 | 8/2005 | Kaaret et al. | |
| 2006/0003913 | A1 | 1/2006 | Boutique et al. | |
| 2006/0021150 | A1 | 2/2006 | Hu et al. | |
| 2006/0030513 | A1 | 2/2006 | Binder et al. | |
| 2006/0074005 | A1 | 4/2006 | Kischkel et al. | |
| 2006/0154836 | A1 | 7/2006 | Sengupta et al. | |
| 2006/0183662 | A1 | 8/2006 | Crotty et al. | |
| 2006/0217288 | A1 | 9/2006 | Wahl et al. | |
| 2006/0276370 | A1 | 12/2006 | Zhang et al. | |
| 2006/0276371 | A1* | 12/2006 | Schreiner et al. | 510/475 |
| 2006/0287216 | A1 | 12/2006 | Song | |
| 2007/0027050 | A1 | 2/2007 | Crotty et al. | |
| 2007/0060489 | A1 | 3/2007 | Sun et al. | |
| 2007/0190009 | A1 | 8/2007 | Guentert et al. | |
| 2007/0277327 | A1 | 12/2007 | Wessling et al. | |
| 2007/0292380 | A1 | 12/2007 | Staudigel et al. | |
| 2008/0096788 | A1 | 4/2008 | Lang | |
| 2008/0103080 | A1 | 5/2008 | Lang | |
| 2008/0103081 | A1 | 5/2008 | Lang | |
| 2008/0131390 | A1 | 6/2008 | Lang | |
| 2008/0317698 | A1* | 12/2008 | Wells et al. | 424/78.08 |
| 2009/0036339 | A1 | 2/2009 | Sans et al. | |
| 2009/0048137 | A1 | 2/2009 | Lang | |
| 2010/0105592 | A1 | 4/2010 | Yoda et al. | |

FOREIGN PATENT DOCUMENTS

| | | | |
|---|---|---|---|
| CA | 2 307 429 | A1 | 11/2000 |
| DE | 35 31 756 | A | 3/1986 |
| DE | 101 16 491 | A1 | 4/2001 |
| DE | 100 64 635 | A1 | 7/2002 |
| DE | 10 2004 051 715 | A1 | 10/2004 |
| DE | 10 2005 039 168 | | 8/2005 |
| EP | 0 264 710 | A1 | 4/1988 |
| EP | 1 114 139 | B1 | 2/2005 |
| EP | 1 146 110 | B1 | 11/2005 |
| GB | 2 164 657 | A | 3/1986 |
| JP | 04050374 | | 2/1992 |
| JP | 11 148093 | | 6/1999 |
| JP | 2000-272234 | A | 10/2000 |
| JP | P2001-107083 | A | 4/2001 |
| JP | P2002-60788 | A | 2/2002 |
| JP | P2002-60789 | A | 2/2002 |
| JP | P2002-60791 | A | 2/2002 |
| JP | P2002-60800 | A | 2/2002 |
| JP | P2006-22203 | A | 1/2006 |
| JP | P2007-31900 | A | 2/2007 |
| WO | WO 00/17297 | | 3/2000 |
| WO | WO 2006/042716 | A1 | 4/2006 |
| WO | WO 2006/042717 | A1 | 4/2006 |
| WO | WO 2006/086811 | | 8/2006 |
| WO | WO 2006/134044 | A1 | 12/2006 |
| WO | WO 2007/107215 | A1 | 9/2007 |

OTHER PUBLICATIONS

U.S. Appl. No. 12/549,422, filed Aug. 28, 2009, Corona, III et al.

U.S. Appl. No. 12/549,413, filed Aug. 28, 2009, Corona, III et al.

U.S. Appl. No. 12/549,712, filed Aug. 28, 2009, Corona, III et al.

* cited by examiner

FABRIC CARE COMPOSITIONS, PROCESS OF MAKING, AND METHOD OF USE COMPRISING PRIMARY PARTICLES COMPRISING CATIONIC POLYMER AND ANIONIC SURFACTANTS

CROSS REFERENCES TO RELATED APPLICATIONS

This application claims priority under 35 U.S.C. §119(e) to U.S. Provisional Application Ser. No. 61/092,633 filed Aug. 28, 2008, and U.S. Provisional Application Ser. No. 61/221,632 filed Jun. 30, 2009.

FIELD OF THE INVENTION

Compositions and methods for using and making fabric care compositions capable of providing one or more benefits, for example, a color care benefit, are disclosed.

BACKGROUND OF THE INVENTION

Depending on the fabric type, colored garments may be prone to fading and color loss. This can result in non-use of the garments and/or consumer dissatisfaction. Dark colors may be particularly susceptible to fading or loss of color. One means of restoring color to faded or worn fabrics is via the use of dyes. While dye compositions may be used to restore colored, faded or worn fabrics, dye compositions generally require complex steps, can be messy to use, and requires color matching of the fabric, which may be difficult in many cases. Accordingly, such methods may be inconvenient to the consumer.

Cationic polymers may be used to provide fabric care benefits. However, because such polymers are positively charged, such polymers may be difficult to formulate with anionic agents such as anionic surfactants often used in detergent compositions. This is particularly the case where cationic polymers are used at higher levels. In fact, at high levels, cationic polymers tend to agglomeration with the anionic surfactants used in detergent compositions to create an unpourable, phase-separated mixture, which is incompatible with consumer use.

Accordingly, there is a need for a product that can provide a color maintenance and/or rejuvenation benefit with or without the use of dyes, which may be sufficiently stable and has a rheology profile acceptable to consumers.

SUMMARY OF THE INVENTION

Compositions and methods for using and making fabric care compositions capable of providing one or more benefits, for example, a color care benefit, are disclosed.

DETAILED DESCRIPTION OF THE INVENTION

As used herein, the articles "a" and "an" when used in a claim, are understood to mean one or more of what is claimed or described.

As used herein, the term "comprising" means various components conjointly employed in the preparation of the compositions of the present disclosure. Accordingly, the terms "consisting essentially of" and "consisting of" are embodied in the term "comprising".

As used herein, the term "additive" means a composition or material that may be used separately from (but including before, after, or simultaneously with) the detergent during a laundering process to impart a benefit to a fabric.

As used herein, the term "coacervate" means a particle formed from the association of a cationic polymer and an anionic surfactant in an aqueous environment. The term "coacervate" may be used interchangeably with the terms "primary particle," "colloidal particle," and "aggregate particle."

As used herein, the term "colloidal particle" means an aggregation of primary particles.

As used herein, "charge density" refers to the charge density of the polymer itself and may be different from the monomer feedstock. Charge density may be calculated by dividing the number of net charges per repeating unit by the molecular weight of the repeating unit. The positive charges may be located on the backbone of the polymers and/or the side chains of polymers. For polymers with amine monomers, the charge density depends on the pH of the carrier. For these polymers, charge density is measured at a pH of 7. ACD refers to anionic charge density, while CCD refers to cationic charge density.

As used herein, the term "Anionic Charge Density (ACD) per use" means the amount of negative charge present in a volume of a single dose of the composition to be dispensed. By way of example, a detergent dose of 78 g containing 22.2% of a surfactant having a molecular weight of 390 g/mol has an ACD calculated as follows: 78 g×0.222=17.3 g/dose anionic surfactant; 1 negative charge per mol or 1 equivalent charge for anionic surfactant=ACD of 17.3×1/390×1000=44.3 meq anionic charge per dose.

As used herein, the term "Cationic Charge Density (CCD) per use" means the amount of positive charge present in a volume of a single dose of the composition to be dispensed. By way of example, a detergent dose of 78 g containing 4% of a cationic polymer having a molecular weight of 150,000 and a monomer molecular weight of 161.67 g/mol will have a CCD calculated as follows: The polymer charge density is 1/161.67×1000 or 6.19 meq/g, and the CCD is 78 g×0.04×6.19, or 19.3 meq per dose.

As used herein, the term "black" as applied to a garment, may be defined as the color measured by Hunter L with an L value range from about 0 to about 18. An example of a black color specification is palette number 19-4005tc used as black for the black T-shirt manufactured and sold by the Gildan textile company, 600 de Maisonneuve West, 33rd Floor, Montreal (Quebec), H3A 3J2 Canada. This color also corresponds in the CMYK Color Model of 100-35-0-100 wherein CMYK is defined as C for cyan, M for magenta, Y for yellow, and K is key for black. The CMYK ISO standard is ISO 12640-1:1997 and can be accessed at www.iso.org.

As used herein, the term "cationic polymer" means a polymer having a net cationic charge.

As used herein, the term "dry" as applied to a fabric, means a fabric having about 14% residual moisture.

As defined herein, "essentially free of" a component means that no amount of that component is deliberately incorporated into the composition.

As used herein, the term "external structurant" refers to a selected compound or mixture of compounds which provides structure to a detergent composition independently from, or extrinsic from, any structuring effect of the detersive surfactants present in the composition.

As used herein, "fabric care and/or cleaning compositions" include fabric care compositions for handwash, machine wash and/or other purposes and include fabric care additive compositions and compositions suitable for use in the soaking and/or pretreatment of fabrics. They may take the form of, for example, laundry detergents, fabric conditioners and/or other wash, rinse, dryer added products, and sprays. Fabric care compositions in the liquid form may be in an aqueous carrier. In other aspects, the fabric care compositions may be in the form of a granular detergent or dryer added fabric softener sheet. The term "fabric care and/or cleaning compositions" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; cleaning auxiliaries such as bleach additives and "stain-stick" or pre-treat types, substrate-laden products, dry and wetted wipes and pads, nonwoven substrates, and sponges; and sprays and mists. The fabric care and/or cleaning composition may be provided in pouches, including foil or plastic pouches or water soluble pouches, such as a polyvinyl alcohol (PVA) pouch; dosing balls or containers; containers with readily opened closures, such as pull tabs, screw caps, foil or plastic covers, and the like; or other container known in the art. In one aspect, the compositions may be compacted, comprising less than about 15% water, or less than about 10% water, or less than about 7% water.

As used herein, "high charge density" means a charge density of greater than about 1 meq/g. "Low charge density" means a charge density of less than about 1 meq/g.

As used herein, the phrase "high molecular weight" means a molecular weight of greater than about 1,000,000 kD. The phrase "low molecular weight" means a molecular weight of from about 1,000 to about 500,000 kD.

As used herein, "isotropic" means a clear mixture, (having no visible haziness and/or dispersed particles) and having a uniform transparent appearance.

As used herein, the "L*C*h color space" and "L*a*b* color space" refer to the three dimensional colorimetric models developed by Hunter Associates Laboratory and recommended by the Commission Internationale d'Eclairage ("CIE") to measure the color or change in color of a dyed article. The CIE L*a*b* color space ("CIELAB") has a scale with three-fold axes with the L axis representing the lightness of the color space (L*=0 for black, L*=100 for white), the a* axis representing color space from red to green (a*>0 for red, a*<0 for green) and the b* axis representing color space from yellow to blue (b*>0 for yellow, b*<0 for blue). The L*C*h color space is an approximately uniform scale with a polar color space. The CIE L*C*h color space ("CIELCh") scale values are determined instrumentally and may also be calculated from the CIELAB scale values. As used herein, the $DE^*_{CMC}$ value includes the vector associated with the distance in the L*C*h space between the initial L*C*h value and the final L*C*h value. As used herein the DE* value includes the vector associated with the distance in the L*a*b* space between the initial L*a*b* value and the final L*a*b*. The L* lightness value is the same for both the CIELCh and CIELAB color scales. The C* value (chroma value) and the h value (hue angle) may be calculated from the a* and b* values of the CIELAB scale. All colors are represented by a coordinate in the L*a*b* color space and changes in colors are represented by the vector corresponding to the coordinate difference between an initial color and a final color. Term definitions and equation derivations are available from Hunter Associates Laboratory, Inc. and from www.hunterlab.com.

As defined herein, "stable" means that no visible phase separation is observed for a period of at least about two weeks, or at least about four weeks, or greater than about a month or greater than about four months, as measured using the Floc Formation Test, described in USPA 2008/0263780 A1.

As used herein, the terms "color rejuvenation" or "color restoration" of a fabric means enhancing or making more vivid or vibrant the appearance of colored or dyed fabrics. Rejuvenation or restoration can be determined empirically by calculating the ΔL value using the methods described herein, wherein a treated fabric has a ΔL value of greater than about −0.01. The term includes restoring the color appearance of a faded fabric and improving the color appearance of a new or faded fabric to "better than new."

As used herein, "structured phase" means that portion of a composition comprising primary and/or colloidal particles when separated by centrifugation.

As used herein, the term "continuous phase" means that portion of a composition substantially free from particles upon separation by centrifugation.

As used herein, the term "residence time" means the average amount of time a fluid remains within a mixing chamber, and may be determined by calculating the active volume of the device where the fluid stream receives the highest concentration of power input divided by the flow rate of the stream out of the mixing chamber.

As used herein, "unit dose" means an amount of fabric care composition suitable to treat one load of laundry, such as from about 0.05 g to about 100 g, or from 10 g to about 60 g, or from about 20 g to about 40 g.

All measurements are performed at 25° C. unless otherwise specified.

The test methods disclosed in the present application should be used to determine the respective values of the parameters of Applicants' invention.

Unless otherwise noted, all component or composition levels are in reference to the active portion of that component or composition, and are exclusive of impurities, for example, residual solvents or by-products, which may be present in commercially available sources of such components or compositions.

Without being limited by theory, Applicants believe the cationic polymers of the disclosed compositions coalesce with anionic surfactant to form a coacervate system. The coacervate, in turn, is believed to deliver a benefit to the treated fabric without the necessity of dyes via formation of a thin film on the fiber of the treated fabric. This then reduces the diffraction of light that contributes to the appearance of faded or worn fabric. In a further aspect, Applicants have recognized that the disclosed compositions and methods address the problems of instability described above. Without being bound by theory, Applicants believe the stability of the system may be influenced by selection of specific polymers having particular molecular weight ranges and charge densities. In this aspect, Applicants have found that the use of polymers having too high of a molecular weight and too high of a charge density, in combination with anionic surfactants, can result in flocculation, and that this effect can be mitigated by selection of a high molecular weight-low charge density polymer or a low molecular weight-high charge density polymer. In another aspect, Applicants have recognized that particle size of the agglomerates can be controlled and that such particle size can contribute to the stability of compositions containing relatively high levels of both cationic polymer and anionic surfactant.

Compositions—Compositions comprising a) a structured phase, said structured phase comprising primary particles comprising cationic polymer and anionic surfactant; wherein from about 50% to 100%, or from about 60% to about 70%, or from about 80% to 90% of said primary particles have a primary particle size of from about 0.01 μm to about 500 μm, or from about 0.1 μm to about 250 μm, or from about 0.5 μm to about 50 μm; and b) optionally, colloidal particles, said colloidal particles comprising primary particles, wherein from about 70% to 100%, or from about 80% to 90% of the colloidal particles have a particle size of from about 0.01 μm to about 1000 μm, or from about 0.1 μm to about 500 μm, or from about 0.5 μm to about 100 μm, or from about 1.0 μm to about 50 μm are disclosed.

Cationic Polymer—In one aspect, the compositions may comprise from about 0.1% to about 30%, from about 0.5% to about 20%, from about 1.0% to about 10%, or from about 1.5% to about 8%, by weight of the composition of a cationic polymer. In one aspect, the cationic polymer may comprise a cationic polymer produced by polymerization of ethylenically unsaturated monomers using a suitable initiator or catalyst. These are disclosed in WO 00/56849 and U.S. Pat. No. 6,642,200.

In one aspect, the cationic polymer may be selected from the group consisting of cationic or amphoteric polysaccharides, polyethyleneimine and its derivatives, a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N, N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl)aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof. The cationic polymer may optionally comprise a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may be a terpolymer made from more than two monomers. The polymer may optionally be branched or cross-linked by using branching and crosslinking monomers. Branching and crosslinking monomers include ethylene glycoldiacrylate divinylbenzene, and butadiene. In one aspect, the cationic polymer may include those produced by polymerization of ethylenically unsaturated monomers using a suitable initiator or catalyst, such as those disclosed in WO 00/56849 and U.S. Pat. No. 6,642,200. In one aspect, the cationic polymer may comprise charge neutralizing anions such that the overall polymer is neutral under ambient conditions. Suitable counter ions include (in addition to anionic species generated during use) include chloride, bromide, sulfate, methylsulfate, sulfonate, methylsulfonate, carbonate, bicarbonate, formate, acetate, citrate, nitrate, and mixtures thereof.

In one aspect, the cationic polymer may be selected from the group consisting of poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-methacryloamidopropyl-pentamethyl-1,3-propylene-2-ol-ammonium dichloride). These cationic polymers include and may be further described by the nomenclature Polyquaternium-1, Polyquaternium-5, Polyquaternium-6, Polyquaternium-7, Polyquaternium-8, Polyquaternium-1, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the cationic polymer may comprise a cationic acrylic based polymer. In one aspect, the cationic polymer may comprise a cationic polyacrylamide. In one aspect, the cationic polymer may comprise poly(acrylamide-N,N-dimethylaminoethyl acrylate) and its quaternized derivatives. In this aspect, the cationic polymer may be that sold under the tradename Sedipur®, available from BTC Specialty Chemicals, BASF Group, Florham Park, N.J.

In one aspect, the cationic polymer may comprise poly (acrylamide-co-methacrylamidopropyltrimethyl ammonium chloride).

In one aspect, the cationic polymer may comprise a non-acrylamide based polymer, such as that sold under the tradename Rheovis® CDE, available from Ciba Specialty Chemicals, a BASF group, Florham Park, N.J., or as disclosed in USPA 2006/0252668.

In one aspect, the cationic polymer may comprise polyethyleneimine or a polyethyleneimine derivative. In one aspect, the cationic polymer may be a polyethyleneinine such as that sold under the tradename Lupasol® by BASF, AG, Lugwigschaefen, Germany In one aspect, the cationic polymer may include alkylamine-epichlorohydrin polymers, which are reaction products of amines and oligoamines with epicholorohydrin. These include those polymers listed in U.S. Pat. Nos. 6,642,200 and 6,551,986. Examples include dimethylamine-epichlorohydrin-ethylenediamine, and available under the trade name Cartafix® CB and Cartafix® TSF from Clariant, Basle, Switzerland.

In one aspect, the cationic polymer may comprise a synthetic cationic polymer comprising polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994), at pp. 13-44.

In one aspect, the cationic polymer may be selected from the group consisting of cationic or amphoteric polysaccharides. In one aspect, the cationic polymer may comprise a polymer selected from the group consisting of cationic and amphoteric cellulose ethers, cationic or amphoteric galactomanan, cationic guar gum, cationic or amphoteric starch, and combinations thereof.

In one aspect, the cationic polymer may comprise an amphoteric polymer, provided the polymer possesses a net positive charge. Said polymer may have a cationic charge density of about 0.05 to about 18 milliequivalents/g.

In one aspect, the cationic polymer may have a cationic charge density of from about 0.005 to about 23, from about 0.01 to about 12, or from about 0.1 to about 7 milliequivalents/g, at the pH of the intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

In one aspect, the cationic polymer may have a weight-average molecular weight of from about 500 to about 5,000,000, or from about 1,000 to about 2,000,000, or from about 2,500 to about 1,500,000 Daltons as determined by size exclusion chromatography relative to polyethyleneoxide standards with RI detection. In one aspect, the molecular weight of the cationic polymer may be from about 500 to about 37,500 kD. The cationic polymers may also range in both molecular weight and charge density. The cationic polymer may have a charge density of from about 0.05 meq/g to about 12 meq/g, or from about 1.0 to about 6 meq/q, or from about 3 to about 4 meq/g at a pH of from about pH 3 to about pH 9. In one aspect, the one or more cationic polymer may have a weight-average molecular weight of 500 Daltons to about 37,500 Daltons and a charge density from about 0.1 meq/g to about 12.

Anionic Surfactant—The compositions may be formulated for use as any of a variety of laundry care treatment compositions, the surfactant system being selected based on the desired application.

In one aspect, the composition may comprise, by weight of the composition, from about 0.1% to about 50%, or from about 7% to about 40%, or from about 10% to about 20% of an anionic surfactant. Non-limiting examples of suitable anionic surfactants include those described in U.S. patent application Ser. No. 12/075,333. In one aspect, the anionic surfactant may comprise alkylethoxysulfonate (AES). In one aspect, the composition may comprise, by weight of the composition, less than about 5%, or less than about 10%, or less than about 50% linear alkyl benzene sulfonate (HLAS).

In one aspect, the composition may comprise an anionic surfactant having an HLB value of from about 4 to about 14, or from about 8 to about 10, or about 9.

In one aspect, the anionic surfactants and cationic polymers of the compositions may be selected based on the ACD:CCD ratio, such that the ACD:CCD ratio of the compositions may be from about 100 to about 0.01, or from about 10 to about 0.05 or from about 5 to about 0.10. In one aspect, the ACD:CCD ratio may be about 500 to 1, or about 200 to 1, or about 10 to 1, or about 2.3 to 1.

In one aspect, the composition may be a detergent, and may have an ACD:CCD ratio of about 2.3:1. In one aspect, the composition may be an additive, and may have an ACD:CCD ratio of about 0.79:1. In one aspect, the composition may have an ACD per use of from about 20 to about 200, or from about 30 to about 100, or from about 40 to about 50 meq. In one aspect, the composition may have a CCD per use of from about 5 to about 1000, or from about 10 to about 500, or from about 15 to about 75 meq.

In one aspect, the composition may comprise, by weight of the composition, less than about 1%, or less than about 5%, or less than about 10%, or less than about 50% nonionic surfactant. In one aspect, the composition may be essentially free of a nonionic surfactant.

External Structurant—In one aspect, the composition may comprise an external structurant. Generally the organic external structurant will contain from 0.001% to 1.0%, or from 0.05% to 0.5%, or from 0.1% to 0.3% by weight, of the compositions herein. Suitable structurants include those described, for example, in USPAs 2007/169741B2 and 2005/0203213, and hydrogenated castor oil, commercially available as Thixin®.

Dispersing Agent—In one aspect, the composition may comprise a dispersing agent. The dispersing agent may be present at levels of from about 0% to about 7%, or from about 0.1% to about 5%, or from about 0.2% to about 3% by weight of the final composition. In one aspect, the dispersing agent may be substantially water soluble.

In one aspect, the dispersing agent may be a nonionic surfactant. Suitable nonionic surfactants include addition products of ethylene oxide and, optionally, propylene oxide, with fatty alcohols, fatty acids, fatty amines, etc. They may be referred to herein as ethoxylated fatty alcohols, ethoxylated fatty acids, and ethoxylated fatty amines. Any of the ethoxylated materials of the particular type described hereinafter can be used as the nonionic surfactant. Suitable compounds include surfactants of the general formula: $R^1$—Y—$(C_2H_4O)_z$—$C_2H_4OH$ wherein $R^1$ may be selected from the group consisting of primary, secondary and branched chain alkyl and/or acyl and/or acyl hydrocarbyl groups; primary, secondary and branched chain alkenyl hydrocarbyl groups, and primary, secondary and branched chain alkyl- and alkenyl substituted phenolic hydrocarbyl groups; said hydrocarbyl groups having a hydrocarbyl chain length of from about 8 to about 20, or from about 9 to about 18 carbon atoms. In the general formula for the ethoxylated nonionic surfactants herein Y may be —O—, —C(O)O—, or —O—, and in which $R^1$, when present, have the meanings given hereinbefore, and z may be at least about 4, or about 7 to about 25.

In one aspect, the dispersing agent may include a material having the general formula: $R^1O(CH(R^2)CH_2O)x(CH2CH_2O)yR^3$ or $R^1O(CH_2CH2O)x(CH(R^2)CH_2O)yR^3$ wherein $R^1$ may be defined as above; $R^2$ may be a $C_1$-$C_3$ alkyl unit; and $R^3$ may be hydrogen or $C_1$-$C_3$ alkyl. The individual alkoxy monomers may be arranged blockwise or randomly. Non-limiting examples include the Plurafac® surfactants from BASF. Other suitable dispersing agents include the so-called propyleneoxide/ethyleneoxide block copolymers, having the following general structure: HO(CH2CH2O)x(CH(CH3)CH2O)y(CH2CH2O)zH. Such agents include the Pluronic® PE compounds from BASF.

In one aspect, the composition may a detergent adjunct ingredient selected from the group consisting of fatty acids, brighteners, chelating agents, dye transfer inhibiting agents, enzymes, enzyme stabilizers, and pearlescent agents. Such adjuncts may be suitable for use in the instant compositions and may be desirably incorporated in certain aspects. In addition to the disclosure below, suitable examples of such other adjuncts and levels of use may be found in U.S. Pat. Nos. 5,576,282, 6,306,812 B1 and 6,326,348 B1.

Organosilicone—In one aspect, the fabric care compositions may comprise from about 0.1% to about 30%, from about 0.5% to about 20%, from about 1.0% to about 10%, or from about 1.5% to about 8%, by weight of the fabric care composition of an organosilicone. Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked. In one aspect, the organosilicones may be linear.

In one aspect, the organosilicone may comprise a non-functionalized siloxane polymer that may have Formula I below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula I)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from about 0 to about 10, or from about 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the trade names DC 200 Fluid, DC 1664, DC 349, DC 346G available from offered by Dow Corning Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning Corporation, and various Silwet surfactants available from Momentive Silicones.

In another aspect, the functionalized siloxane polymer may comprise an aminosilicone. Suitable aminosilicones are described in U.S. Pat. Nos. 7,335,630 B2, 4,911,852, and USPA 2005/0170994A1. In one aspect the aminosilicone may be that described in and cite filed X22 application. In another aspect, the aminosilicone may comprise the structure of Formula II:

$$[R_1R_2R_3SiO_{1/2}]_n[(R_4Si(X\text{-}Z)O_{2/2}]_k[R_4R_4SiO_{2/2}]_m[R_4SiO_{3/2}]_j \quad \text{(Formula II)}$$

wherein i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s— wherein s may be an integer from about 2 to about 10; —

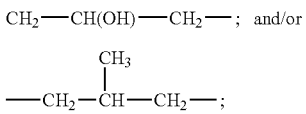

iii. Each Z may be independently selected from —$N(R_5)_2$; —$N(R_5)_3A^-$,

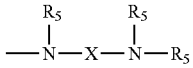

or

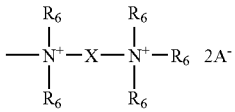

and/or

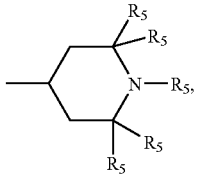

wherein each $R_5$ may be selected independently selected from H, $C_1$-$C_{20}$ alkyl, $C_1$-$C_{20}$ substituted alkyl, $C_6$-$C_{20}$ aryl, $C_6$-$C_{20}$ and/or substituted aryl, each $R_6$ may be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy; and $A^-$ may be a compatible anion. In one aspect, $A^-$ may be a halide;

iv. k may be an integer from about 3 to about 20, preferably from about 5 to about 18 more preferably from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from about 0 to about 10, or from about 0 to about 4, or 0;

In one aspect, $R_1$ may comprise —OH. In this aspect, the organosilicone may be amodimethicone.

Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones).

In another aspect, the functionalized siloxane polymer may comprise silicone-urethanes, such as those described in U.S. PA 61/170,150. These are commercially available from Wacker Silicones under the trade name SLM-21200.

When a sample of organosilicone is analyzed, it is recognized by the skilled artisan that such sample may have, on average, non-integer indices for Formula I and II above, but that such average indice values will be within the ranges of the indices for Formula I and II above.

Rheology

In one aspect, the composition may have a pouring viscosity of from about 10 centipoises at 20/sec to about 20,000, or from about 10 centipoises to 2000, or from about 100 centipoises to about 2000 centipoises at 20/sec. In another aspect, the composition may have a resting viscosity of from about 10,000 to about 225,000, or from about 10,000 to about 50,000, or about 30,000 cps @0.05/s.

In one aspect, the composition may comprise a structured phase wherein the structured phase comprising, by weight of the composition, from about 5% to about 100%, or from about 10% to about 90%, or from about 20% to about 80% of the composition when centrifuged at 10,000 rpm. In one aspect, salts may be added to adjust phase stability.

In one aspect, the composition may comprise, by volume of the composition, from about 0.5% to about 100% or from about 5% to about 90%, or from about 10% to about 70%, or from about 20% to about 50% of the structured phase as determined by centrifugation.

In one aspect, the composition may have a G' of from about 0.5 Pa to about 50,000 Pa as determined from a strain sweep at 3.142 rad/sec, and a G" of from about 0.5 Pa to about 50,000 Pa, as determined from a strain sweep at 3.142 rad/sec. In one aspect, the G' may be greater than G" at less than about 20% strain.

In one aspect, the composition may be birefringent.

Density—In one aspect, the composition may comprise a structured phase and a continuous phase, wherein the density difference between the structured phase and the continuous phase, as separated by centrifugation, may be from about 0.2 to about 0.8, or from about 0.4 to about 0.6. In one aspect, composition may comprise a structured phase and a continuous phase, wherein the density difference may be less than about 0.2.

Refractive Index—In one aspect, the composition may comprise primary particles having a refractive index on the fiber of from about 1.33 to about 1.6, or from about 1.45 to about 1.50 as measured by the Refractive Index Determination as defined below.

Transition Temperature—In one aspect, the structured phase has a transition temperature of less than about 50° C., or less than about 30° C.

Dilution—In one aspect, the primary and/or colloidal particles may be formed on dilution, wherein said composition is diluted at a ratio of about 1 part composition to 10 parts wash liquor, said colloidal structures having a particle size of from about 5 μm to about 1000 μm, or from about 5 μm to about 500 μm, or from about 10 μm to about 200 μm.

In another aspect, the primary and/or colloidal particles may be formed on dilution, wherein said composition is diluted at a ratio of about 1 part composition to about 3800 parts wash liquor, said primary and/or colloidal particles having a particle size of from about 0.005 μm to about 1000 μm, or from about 0.01 μm to about 100 μm.

In one aspect, the composition, under wash conditions, may comprise primary and/or colloidal particles, said primary and/or colloidal particles having a particle size of from about 0.005 μm to about 1000 μm, or from about 0.01 μm to about 500 μm, or from about 0.1 μm to about 100 μm.

In one aspect, the composition, under wash conditions, may comprise a coacervate having an elastic and viscous modulus of from about 10 to about 1,000,000 Pa, or from about 100 to about 200,000 Pa, or from about 500 to about 100,000 Pa in the frequency range 0.1 to 100 rad/s as measured using the Test Methods herein.

TABLE I

Composition properties and rheology. Table I illustrates the stability of compositions which contain the desired particle size as compared to compositions that do not contain the desired particle size. The shear rate at 0.1 $s^{-1}$ (measure of rheology for the composition at rest) is commonly thought to be an indicator of long term stability. In one aspect, the compositions have a shear rate at 0.1 s−1 of greater than about 6,000 cps.

| Composition | Formula I | Formula I | Formula I | Formula I |
|---|---|---|---|---|
| Process | Simple Mixing | High Energy Dispersion Step | High Energy Dispersion Step | High Energy Dispersion Step |

TABLE I-continued

Composition properties and rheology. Table I illustrates the stability of compositions which contain the desired particle size as compared to compositions that do not contain the desired particle size. The shear rate at 0.1 $s^{-1}$ (measure of rheology for the composition at rest) is commonly thought to be an indicator of long term stability. In one aspect, the compositions have a shear rate at 0.1 s−1 of greater than about 6,000 cps.

| Composition | Formula I | Formula I | Formula I | Formula I |
|---|---|---|---|---|
| Primary Particle Size | 10-500 micron | 2 to 10 micron | 2 to 10 micron | 2 to 10 micron |
| Aggregate | Many structures >100 micron | 10 to 100 micron | 10 to 100 micron | 10 to 100 micron |
| Structurant | — | — | 0.1% Trihydroxystearin | 0.3% Trihydroxystearin |
| Visual Appearance | Contains chunks of solid-like material | Smooth, fluid, opaque-translucent | Smooth fluid, opaque-translucent | Higher viscosity, opaque |
| Stability at 70 F. | Separates in 24 hrs | 4 Days | at least 2 weeks | at least 4 months |
| Shear Rate 0.1 $s^{-1}$ | 15,000 cps | 6,500 cps | 10,000 cps | 50,000 cps |
| Shear Rate 10 $s^{-1}$ | 1,200 cps | 1,000 cps | 600 cps | 2,000 cps |

Method of Using

In one aspect, a method of providing a benefit selected from the group consisting of abrasion resistance, wrinkle removal and/or prevention, pill prevention, anti-shrinkage, anti-static, anti-crease, fabric softness and/or feel, fabric shape retention, suds suppression, decreased residue in the wash or rinse, and/or improved hand feel or texture, and combinations thereof, is disclosed. In one aspect, the benefit may be a color benefit.

In one aspect, the method may comprise the step of contacting a fabric with a composition described herein, wherein the composition provides a ΔL value as measured on a textile of about −0.01 to about −15, or from about −0.1 to about −10, or from about −1 to about −5.

Test Methods

Fabric Damaging Protocol—New black Gildan t-shirts ("garment") (6.1 oz 100% pre-shrunk cotton, double needle stitching, seamless collar, taped neck and shoulders, quarter turned body), available from TSC Apparel, Cincinnati, Ohio, or a suitable equivalent, are used. (Mill Number: 2000; Mill: Gildan; Style number: 0281 GL; Color: Black; Size: Large or extra large.) 49.6±0.01 grams of commercially available 2× Ultra Tide® detergent is used per cycle. Each garment is washed a total of 10 times, with complete drying (approximately 14% residual moisture) in-between each cycle. The wash conditions are as follows: Water: City water having 8.1 gpg average hardness and 1 ppm average chlorine. Washing machine used is Kenmore 80 Series, Heavy Duty, Super Capacity Plus, Quiet Pak, 3 speed motor with 4 speed combination, Ultra Rinse System, model number 110.64832400. Clothing is washed using the "Heavy Duty Fast/Fast" cycle using 17 gallons (64.35 Liters) water having a temperature of about 60° F. for 12 minutes. One two minute rinse is performed using water having a temperature of about 60° F. The total garment weight in the washer is 5.5 pounds (or 11 whole Gildan t-shirts). The garments are then dried using a Kenmore electric 80 Series, Heavy Duty, Super Capacity Plus, Quiet Pak, model number 110.64832400. The garments are dried for about 60 minutes at a temperature of 186° F. (the "Cotton High" cycle). After the drying step, the garments generally have no noticeable moisture, or about 14% residual water content. The wash and dry cycles are repeated for a total of 10 times unless otherwise indicated.

Treatment Protocol—The test composition is diluted in a top loading machine containing 17 gallons of city water (about 8 gpg) at 60° F., for 12 minutes. The garment is then rinsed using 17 gallons 60 deg F. city water (about 8 gpg), for 2 minutes. The garment is then dried to the touch (i.e., until garment has approximately 14% residual moisture).

Color/Appearance Benefit—The color and appearance benefit imparted to fabrics can be described, for example, in terms of the refractive index of the fiber before and after treatment of the fabric as defined as a ΔL value measured via spectrophotometry (for example, via a Hunter spectrophotometer as described herein). A decrease in L value, represented by a negative delta L value, indicates an improvement (or darkening) in color, which represents a rejuvenation benefit. In this aspect, the L* value is determined before and after the fabric is treated using the method. The difference, or ΔL, indicates the degree of "rejuvenation" or improvement of appearance in the treated fabric. The ΔL value of the fabric can be determined using the Fabric Damaging Protocol to yield damaged fabrics, followed by the Treatment Protocol. L* values are determined on the damaged and treated fabric. A typical $L_{(damaged)}$ value for a black Gildan T-Shirt described is from about 12 to about 14. The ΔL value is equal to the $L_{(damaged)}$-the $L_{(treated)}$ value.

Refractive Index Determination—The refractive index of a material may be given as the ratio of the speed of light in a vacuum relative to the speed of light in the material. For uncommon materials, n is typically not known and must be measured. Using the Becke line method, particles are dispersed in liquids of known refractive index and examined on a microscope slide under monochromatic light. Upon moving from best focus to focusing above the particle, a halo which forms around the particle (the Becke line) will be observed to move into the particle or into the surrounding liquid. The direction of movement of the Becke line is towards the higher refractive index. The refractive index of the liquid is changed accordingly until the particles virtually disappear, indicating that the refractive indices of the particle and liquid match. It is assumed that the particle does not dissolve or swell in the liquid during the measurement of the particle. To determine the refractive index, isolated coacervate is placed on a glass microscope slide. The particle is immersed in a liquid of known refractive index and covered with a coverslip. Liquids used are selected from the set of Cargille Certified Refractive Index Liquids, available from SPI Supplies. The coacervate is immersed in the liquid is brought into best focus on a light microscope set in axial illumination with a 589 nm interference filter placed over the light source. The relative value of refractive index of the particle (which is unknown) compared to the liquid (which is known) is determined by observing the direction of movement of the Becke line, the halo which forms around the particle. The Becke line moves in the direction of higher refractive index when focusing above the coacervate, or conversely towards lower refractive index when focusing below the particle. The process of immersing the particle in a known refractive index liquid and observing the movement of the Becke lines is repeated systematically until either the refractive index of the coacervate is matched or it is bound between two values.

Particle sizing—Particle size and structure in neat product (i.e., undiluted composition as described herein) is determined via light microscopy. A drop of neat product is placed on a glass microscope slide and covered with a glass coverslip. The coacervate particles are identified by their birefringent nature indicating a liquid crystalline character. These coacervate particles can be identified from other possible particulates in the formulation both by this birefringent nature, and either by inspection of the formulation in the absence of cationic polymer, and hence, in the absence of coacervate formation, or by systematic evaluation of other components in the mixture. Quantification of primary and colloidal particle size is completed by image analysis of the microscopy pictures. Often enhanced contrast techniques are used to improve contrast between the coacervate particles and the surrounding liquid, including differential interference contrast, phase contrast, polarized light, and/or the use of fluorescent dyes. Additional droplets are imaged to ensure that the resulting images and particle sizes are representative of the entire mixture.

Particle size under dilution may be determined using microscopy (light microscopy as described above, or electron microscopy if the particles are too small to be visible by light microscopy) and/or laser scattering techniques such as laser diffraction with Mie theory, dynamic light scattering, or focused beam reflectance mode. Often these techniques are used together, in that microscopy is used to identify the coacervate particles from other possible particulates in solution and scattering techniques offer a more rapid quantification of particle size. The choice of scattering method depends on the particle size of interest and the concentration level of particles in solution. In dynamic light scattering (DLS), the fluctuations in scattered light due to Brownian motion of the particles are measured. These fluctuations are correlated to obtain a diffusion coefficient and therefore a hydrodynamic radius of particles. This technique is used when the particles are less than a few microns and the solution conditions are dilute. In laser diffraction, the light scattered by the particles is measured by a series of detectors placed at different angles. The use of back scattering detectors and Mie theory enables detection of particle sizes less than 1 micron. This technique can be utilized to measure particles over a broader size range compared to DLS, and resolution of two populations of particle sizes (such as primary and colloidal particles) can be determined provided the difference in sizes is significant enough. In a focused beam reflectance measurement (FBRM), a chord length distribution, which is a "fingerprint" of the particle size distribution, is obtained. In FBRM, a focused laser beam scans across particles in a circular path, and as the beam scans across particles the backscattered light is detected as pulses of light. The duration of the pulse is converted to a chord length, and by measuring thousands of chord lengths each second, the chord length distribution is generated. As in the case of laser diffraction, detection of two size populations can be obtained provided the differences in size is great enough. This technique is used when the particles are greater than approximately 1 micron and is particularly useful when the turbidity and/or particle concentration in solution is high.

Dilution under Wash Conditions—Preparation of samples under wash conditions for characterization of particle size and/or rheology is as follows: 50.5 grams of Tide 2×, available from The Procter and Gamble Company (containing 20.06% AES, 2.67% HLAS and 0.80% Nonionic Surfactant) and 80 grams of sample composition is added to a Kenmore 80 Series, Heavy Duty, Super Capacity Plus, Quiet Pak, 3 speed motor with 4 speed combination, Ultra Rinse System, model number 110.25842400 top-loading washing machine. The mixture is allowed to agitate in the machine using the "Heavy Duty Fast/Fast" cycle (having 17 gallons (64.35 Liters) water at a temperature of about 60° F.), and stopped after 12 minutes. Water quality is 6 gpg. Samples of the solution are extracted immediately after the cycle is stopped for characterization of particle size or rheology as described herein.

Rheology/Adhesive Mapping—The frequency dependence of the material is obtained from a frequency sweep carried out under linear viscoelastic conditions. The structured phase (comprising particles) is separated from wash solutions by centrifugation at a speed and time sufficient to isolate particles as indicated by a substantially clear supernatant. As a result of centrifugation, a viscous gel-like layer comprising coalesced particles forms and separates as the bottom phase. A low viscosity supernatant is present. The supernatant is decanted to isolate the gel-like layer for further testing. The linear viscoelastic region is identified as follows: using a stress-controlled rheometer equipped with parallel plate geometry (12 mm, or 25 mm; selected based on modulus of the gel phase, as readily understood by one of skill in the art), a dynamic stress sweep, where G' (elastic modulus) and G" (viscous modulus) are measured as a function of stress, is run at a fixed frequency 1 rad/s. The linear viscoelastic region is defined as the stress range over which G' and G" are constant, i.e. independent of stress. A dynamic frequency sweep, where G' and G" are measured as a function of frequency between 0.1 and 100 rad/s is then run at a stress within this linear viscoelastic regime. A viscoelastic "window" is then formed by plotting G' on the y-axis and G" on the x-axis, with the upper right corner of the window corresponding to the high frequency point i.e. G"(100 rad/s), G'(100 rad/s) and the lower left corner corresponding to the low frequency point i.e. G"(0.1 rad/s), G'(0.1 rad/s).

The Particle Size, Refractive Index and Rheology/Adhesive Mapping test methods may be employed to evaluate consumer product compositions and components. A representative, non-limiting list of product categories includes antiperspirants, baby care, colognes, commercial products (including wholesale, industrial, and commercial market analogs to consumer-oriented consumer products), cosmetics, deodorants, dish care, feminine protection, hair care, hair color, health care, household cleaners, incontinence care, laundry, oral care, paper products, personal cleansing, disposable absorbent articles, pet health and nutrition, prescription drugs, prestige fragrances, skin care, snacks and beverages, special fabric care, shaving and other hair growth management products. Exemplary product forms and brands are described on The Procter & Gamble Company's website www.pg.com, and the linked sites found thereon. It is to be understood that one or more of said test methods may be useful for use in evaluating or measuring consumer products that are part of product categories other than those listed above.

EXAMPLES

TABLE I

Exemplary Detergent Formulations

| Component Material | | Formula 1 | 2 | 3 | 4 | 5 | 6 | 7 | 8 | 9 | 10 |
|---|---|---|---|---|---|---|---|---|---|---|---|
| | | Wt % | | | | | | | | | |
| Alkyl Ethoxylate sulfate | 5.0-20 | 20.1 | 20.5 | 18 | 15 | 20.1 | 20.1 | 15 | 20.1 | 20.1 | 20.1 |
| HLAS (1) | 0-10.0 | — | — | — | — | — | — | — | — | — | — |
| MLAS (2) | 0-5.0 | — | — | — | — | — | — | — | — | — | — |
| Alkyl Ethoxylate | 0-5.0 | 0.3 | 2.0 | 1.5 | 4.0 | 0.5 | 0.7 | 2.5 | 0.3 | 0.3 | 0.3 |
| Lauryl trimethyl ammonium chloride (3) | 0-4.0 | 2.2 | — | — | — | — | — | — | — | — | — |
| Citric Acid | 0-5.0 | 3.4 | 3.4 | 3.4 | 3.4 | 3.4 | 3.4 | 3.4 | 3.4 | 3.4 | 3.4 |
| C1218 TPK FA (4) | 0-5.0 | 2.1 | 0 | 5.0 | 10 | 2.1 | 2.1 | 2.1 | 2.1 | 2.1 | 2.1 |
| Enzyme 54.5 mg/g active (5) | 0-1.0 | 0.4 | 0.4 | 0.4 | 0.4 | 0.4 | 0.4 | 0.4 | 0.4 | 0.4 | 0.4 |
| Natalase - 200L | 0-0.1 | — | 0.3 | — | — | — | — | — | — | — | — |
| Carezyme - 0.5L | 0-0.5 | — | 0.1 | 0.05 | — | — | — | — | 2.0 | — | — |
| Borax | 0-3 | 0.8 | 0.8 | 0.8 | 0.8 | 0.8 | 0.8 | 0.8 | 0.8 | 0.8 | 0.8 |
| Ca Formate | 0-0.1 | — | — | — | — | — | — | — | — | — | — |
| ethoxylated tetraethylene pentaimine | 0-2.0 | 0.7 | — | — | 0.7 | 0.7 | 0.8 | 0.7 | 0.5 | — | 0.7 |
| PE20 (6) | 0-3.0 | 0.7 | 0.7 | 0.7 | 0.7 | 0.7 | 0.7 | 0.7 | 1.5 | 2.0 | 0.7 |
| DTPA (7) | 0-1.0 | 0.5 | 0.5 | 0.5 | 0.5 | 0.5 | 0.5 | 0.5 | 0.5 | 0.5 | 0.5 |
| FWA-15 (8) | 0-0.3 | 0.1 | 0.1 | 0.1 | 0.1 | 0.1 | 0.1 | 0.1 | 0.1 | 0.1 | 0.1 |
| Merquat 100 (9) | 1.0-4.0 | 2.0 | 2.0 | 2.0 | 3.0 | 2.0 | 3.0 | 4.0 | — | 1.5 | — |
| Merquat 106 (10) | 1.0-4.0 | — | — | — | — | — | — | — | 4.0 | — | — |
| Cartafix TSF (12) | 0-3.0 | 2.0 | 2.0 | — | — | 2.0 | — | — | — | 1.0 | — |
| Merquat 5 (13) | | — | — | 2.0 | — | — | — | — | — | — | 3.0 |
| Polyvinyl Pyrrolidone | | — | — | — | 0.5 | — | 0.3 | — | — | — | — |
| PP5495 (14) | 0-4.0 | 2.0 | 2.0 | 2.0 | 2.0 | 0.5 | — | — | — | 0.5 | 1.0 |
| Ethanol | 0-4.0 | 2.8 | 2.8 | 2.8 | 2.8 | 2.8 | 2.8 | 2.8 | 2.8 | 2.8 | 2.8 |
| PEG400 | | 1.5 | 1.5 | 1.5 | 1.5 | 1.5 | 1.5 | 1.5 | 1.5 | 1.5 | 1.5 |
| 1,2-propanediol | 0-6.0 | 3.8 | 3.8 | 3.8 | 3.8 | 3.8 | 3.8 | 3.8 | 3.8 | 3.8 | 3.8 |
| MEA (mono-ethanol amine) | 0-4.0 | 2.5 | 2.5 | 2.5 | 2.5 | 2.5 | 2.5 | 2.5 | 2.5 | 2.5 | 2.5 |
| NaOH | | As Needed to pH 6-9 | | | | | | | | | |
| Na Cumene sulfonate | 0-3.0 | 1.8 | 1.8 | 1.8 | 1.8 | 1.8 | 1.8 | 1.8 | 1.8 | 1.8 | 1.8 |
| Na formate | 0-0.5 | 0.2 | 0.2 | 0.2 | 0.2 | 0.2 | 0.2 | 0.2 | 0.2 | 0.2 | 0.2 |
| Trihydroxyl-stearin | 0-0.5 | 0.2 | 0.2 | 0.2 | 0.2 | 0.2 | 0.2 | 0.2 | 0.2 | 0.2 | 0.2 |
| Suds Suppressor | 0-1.0 | — | — | — | — | — | — | — | — | — | — |
| Acusol OP 301 opacifier | 0-0.5 | — | — | — | — | — | — | — | — | — | — |
| N4 amine | 0-0.02 | 0.2 | 0.2 | — | 0.2 | — | 0.2 | 0.2 | 0.2 | 0.2 | 0.2 |
| Perfume | 0.3-2.5 | 1-2 | 1-2 | 1-2 | 1-2 | 1-2 | 1-2 | 1-2 | 1-2 | 1-2 | 1-2 |
| Water | | Balance to 100% | | | | | | | | | |

TABLE II

Exemplary Detergent Formulations

| Component Material | Wt % | Formula 11 | 12 | 13 | 14 | 15 | 16 | 17 | 18 | 19 |
|---|---|---|---|---|---|---|---|---|---|---|
| | | Wt % | | | | | | | | |
| Alkyl Ethoxylate sulfate | 5.0-20.0 | 12.75 | 15.0 | 14.0 | 12.0 | 12.0 | 6.0 | 6.0 | 10.0 | — |
| HLAS (1) | 0-10.0 | 6.0 | 5.0 | 4.0 | 6.0 | 2.0 | 12.0 | 14.0 | 5.0 | 15.0 |
| MLAS (2) | 0-5.0 | — | | | | | | | | |
| Alkyl Ethoxylate | 0-5.0 | 6.7 | 3.0 | | 5.0 | — | — | 3.0 | | — |
| Lauryl trimethyl ammonium chloride (3) | 0-4.0 | — | | | | | | | | |
| Citric Acid | 0-5.0 | 3.0 | 3.4 | 3.4 | 3.4 | 3.4 | 3.4 | 3.4 | 3.4 | 3.4 |
| C1218 TPK FA (4) | 0-5.0 | 3.3 | 0 | 5.0 | 10 | 2.1 | 2.1 | 2.1 | 2.1 | 2.1 |
| 54.5 mg/g active (5) | 0-1.0 | 0.52 | 0.4 | 0.4 | 0.4 | 0.4 | 0.4 | 0.4 | 0.4 | 0.4 |
| Natalase - 200 L | 0-0.1 | 0.03 | 0.3 | — | — | — | — | — | — | — |
| Carezyme - 0.5 L | 0-0.5 | 0.1 | 0.1 | 0.05 | — | — | — | — | 2.0 | — |
| Borax | 0-3 | 0.8 | 0.8 | 0.8 | 0.8 | 0.8 | 0.8 | 0.8 | 0.8 | 0.8 |
| Ca Formate | 0-0.1 | — | — | — | — | — | — | — | — | — |
| ethoxylated tetraethylene pentaimine | 0-2.0 | 0.7 | — | — | 0.7 | 0.7 | 0.8 | 0.7 | 0.5 | — |
| polyethyleneimine MW600 EO20 (6) | 0-3.0 | 0.7 | 0.7 | 0.7 | 0.7 | 0.7 | 0.7 | 0.7 | 1.5 | 2.0 |
| DTPA (7) | 0-1.0 | 0.5 | 0.5 | 0.5 | 0.5 | 0.5 | 0.5 | 0.5 | 0.5 | 0.5 |
| FWA-15 (8) | 0-0.3 | 0.1 | 0.1 | 0.1 | 0.1 | 0.1 | 0.1 | 0.1 | 0.1 | 0.1 |
| Merquat ® 100 (9) | 0.5-1.0-4.0 | 2.0 | 2.0 | 2.0 | 3.0 | 2.0 | 3.0 | 4.0 | — | 1.5 |
| Merquat ® 106 (10) | 1.0-4.0 | | — | — | — | — | — | — | 4.0 | — |
| Cartafix ® TSF (12) | 0-3.0 | 2.0 | 2.0 | — | — | 2.0 | — | — | — | 1.0 |
| Merquat ® 5 (13) | | | — | 2.0 | — | — | — | — | — | — |
| Polyvinyl Pyrrolidone | | | — | — | 0.5 | — | 0.3 | — | — | — |
| PP5495 (14) | 0-4.0 | 2.0 | 2.0 | 2.0 | 2.0 | 0.5 | — | — | — | 0.5 |
| Ethanol | 0-4.0 | 2.8 | 2.8 | 2.8 | 2.8 | 2.8 | 2.8 | 2.8 | 2.8 | 2.8 |
| PEG400 | 0-6.0 | 1.5 | 1.5 | 1.5 | 1.5 | 1.5 | 1.5 | 1.5 | 1.5 | 1.5 |
| 1,2-propanediol | 0-4.0 | 3.8 | 3.8 | 3.8 | 3.8 | 3.8 | 3.8 | 3.8 | 3.8 | 3.8 |
| MEA (monoethanol amine) | 0-4.0 | 2.5 | 2.5 | 2.5 | 2.5 | 2.5 | 2.5 | 2.5 | 2.5 | 2.5 |
| NaOH | | | | As Needed to pH 6-9 | | | | | | |
| Na Cumene sulfonate | 0-3.0 | 1.8 | 1.8 | 1.8 | 1.8 | 1.8 | 1.8 | 1.8 | 1.8 | 1.8 |
| Na formate | 0-0.5 | 0.2 | 0.2 | 0.2 | 0.2 | 0.2 | 0.2 | 0.2 | 0.2 | 0.2 |
| Trihydroxylstearin | 0-0.5 | 0.2 | 0.2 | 0.2 | 0.2 | 0.2 | 0.2 | 0.2 | 0.2 | 0.2 |
| Suds Suppressor | 0-1.0 | — | — | — | — | — | — | — | — | — |
| Acusol OP 301 opacifier | 0-0.5 | — | — | — | — | — | — | — | — | — |
| N4 amine (16) | 0-0.02 | 0.02 | 0.2 | — | 0.2 | — | 0.2 | 0.2 | 0.2 | 0.2 |
| Perfume | 0.3-2.5 | 0.61 | 1-2 | 1-2 | 1-2 | 1-2 | 1-2 | 1-2 | 1-2 | 1-2 |
| Water | | | | Balance to 100% | | | | | | |

TABLE III

Exemplary Detergent Formulations

| Component Material | Formula 19 | 20 | 21 | 22 | 23 | 24 |
|---|---|---|---|---|---|---|
| | Wt % | | | | | |
| Alkyl Ethoxylate sulfate | 20.9 | 18.0 | 17.7 | — | 20.9 | 18.0 |
| HLAS (1) | — | — | — | 15.0 | — | — |
| MLAS (2) | | | — | | | |
| Alkyl Ethoxylate | | | 0.27 | — | | |
| Lauryl trimethyl ammonium chloride (3) | | | 1.958 | | | |
| Citric Acid | | | 2.956 | 3.4 | | |
| C1218 TPK FA (4) | | | 1.84 | 2.1 | | |
| 54.5 mg/g active (5) | | | 0.42 | 0.4 | | |
| Natalase - 200 L | | | | — | | |

TABLE III-continued

Exemplary Detergent Formulations

| Component Material | Formula 19 | 20 | 21 | 22 | 23 | 24 |
|---|---|---|---|---|---|---|
| | Wt % | | | | | |
| Carezyme - 0.5 L | | | 0.1 | — | | |
| Borax | | | 0.739 | 0.8 | | |
| Ca Formate | | | | — | | |
| Ethoxylated tetraethylene pentaimine | | | | — | | |
| Polyethyleneimine MW600 EO20 (6) | | | — | 2.0 | | |
| DTPA (7) | | | 0.443 | 0.5 | | |
| FWA-15 (8) | | | 0.067 | 0.1 | | |
| Merquat ® 100 (9) | 6.0 | | | 1.5 | 6.0 | |

TABLE III-continued

| Exemplary Detergent Formulations | | | | | | |
|---|---|---|---|---|---|---|
| | Formula | | | | | |
| | 19 | 20 | 21 | 22 | 23 | 24 |
| Component Material | Wt % | | | | | |
| Merquat ® 106 (10) | | | | — | | |
| Merquat ® 280 (11) | | 9.0 | 11.79 | | | 9.0 |
| Cartafix ® TSF (12) | | | | 1.0 | | |
| Merquat ® 5 (13) | | | | — | | |
| Polyvinyl Pyrrolidone | | | | — | | |
| PP5495 (14) | | | 2.0 | 0.5 | | |
| Ethanol | | | 2.48 | 2.8 | | |
| PEG 400 | | | | 1.5 | | |
| PG 105 (15) | | | 0.517 | | | |
| 1,2-propanediol | | | 3.39 | 3.8 | | |
| MEA (monoethanol amine) | | | 2.217 | 2.5 | 2.5 | 2.5 |
| NaOH | | | 2.513 | | | |
| Na Cumene sulfonate | | | 1.552 | | | |
| Na Formate | | | 0.04 | | | |
| Trihydroxylstearin | 0.2 | 0.2 | | | 0.2 | 0.2 |
| Suds Suppressor | | | | | | |
| Acuso ™ OP 301 opacifier | | | | | | |
| N4 amine (16) | | | 0.05 | | | |
| Perfume | 0.3 | 0.3 | 0.61 | | 0.3 | 0.3 |
| Diethylene Glycol (DEG) | | | 1.303 | | | |
| Water | Balance to 100% | | | | | |

(1) Linear alkylbenzene sulfonate
(2) Mid-chain branched linear alkylbenzene sulfonate
(3) lauryl trimethyl ammonium chloride
(4) Topped palm kernel fatty acid
(5) Protease, genetically engineered variant of the detergent protease from *Bacillus Amyloliquifaciens*
(6) polyethyleneimine MW600 EO20
(7) diethylene triamine penta acetate
(8) disodiuma 4,4'-bis{[4-anilino-6-morpholino-s-triazin-2-yl]-amino}-2,2'-stilbenedisulfonate
(9) Homopolymer of diallyldimethyl ammonium chloride, polymer molecular weight of from about 100,000 to about 150,000.
(10) Homopolymer of diallyldimethyl ammonium chloride, polymer molecular weight from about 5,000 to about 15,000
(11) Co-polymer of dimethyldiallyl ammonium chloride and acrylic acid, molecular weight of about 450,000 to 550,000 Daltons
(12) Terpolymer of dimethylamine-epichlorohydrin-ethylenediamine
(13) Poly(acrylamide-co-methacryloyloxyethyltrimethyl ammonium methylsulfate)
(14) Dimethyl, methyl (polyethylene oxide acetate capped) siloxane
(15) Ethoxylated tetraethylene pentaimine
(16) N,N'-Bis(3-aminopropyl)ethylenediamine

Example: Method of Making

The base composition is made by adding the component materials of Table 4 into a dish bottom tank. The component materials are mixed by hand to minimize the amount of air entrapped in the mixture. Upon complete blending, the resulting base composition is clear and isotropic, having a viscosity of from about 200 to about 800 cPS at 20 s-1. 71 liters of base composition is then combined with 25 liters of the isotropic polymer solution. To form the polymer solution, the neat polymer (Nalco, Merquat 100, ~40% active) is diluted with water to form a 11.9% active polymer solution. The base composition is delivered at a rate of 3500 g/min using a Waukesha Pump Model (00602) and the polymer solution is delivered at a rate of 1265 g/min using a Pump (Moyno, E4ASSF3-SKA). The polymer solution and base composition are delivered simultaneously to the head of mill (IKA DR2000/5, two fine grindsets, 50% energy setting). The polymer solution is delivered via a dip tube inserted into the tubing such that the polymer solution is delivered as close as possible to the top of the grind sets without touching, thereby eliminating any air gap between the polymer introduction and dispersion with the base composition. Upon mixing of the base composition and the polymer solution as described above, a mixture containing colloidal particles is formed. Successful attainment of the colloidal particles can be confirmed at this step wherein a dispersed phase of colloid particles suspended in the product is visible via microscopy, the colloidal particles having a diameter of from about 10 to 20 um. Successful attainment of the colloidal particles can also be verified via observation of visible regions of birefringence in the dispersed phase using cross Polared microscopy.

After the polymer solution stream and the base composition stream are combined as described above to obtain a mixture containing colloidal particles, 3.75 liters of Thixcin®, an organic derivative of castor oil, available from Elementis) is introduced at a flow rate of 190 g/min using a Waukesha pump similar to the base composition one (Waukesha, 00618?) The Thixcin® is incorporated at the output of the mill to ensure rapid dispersion of the structurant into the colloid product via-a static mixer (12 element SMX static mixer (1" size) (Sulzer Chemtech). The mixing is complete when the product is passed through the 12 element 1" diameter static mixer at a flow rate of 5 kg's/min. The product is then transferred to a storage container. The final product has a rheology profile of about 20,000-50,000 at low shear (0.5 s-1) and about 200-600 cPS at higher shear (20 s-1). All processing steps are carried out at 20° C.

TABLE IV

| Base Composition Formulation | |
|---|---|
| Component Material | Base Composition (wt %) |
| C25 AE1.8S surfactant | 17.736% |
| Sodium Hydroxide | 2.513% |
| Monoethanol Amine | 2.217% |
| 1,2 Propanediol | 3.236% |
| Diethylene Glycol | 1.419% |
| DTPA (diethylene triamine penta acetate) | 0.443% |
| Citric Acid | 2.956% |
| Sodium Cumene sulfate | 1.552% |
| C12-C18 Fatty Acid | 1.848% |
| Ethoxylated tetraethylene pentaimine | 0.517% |
| Ethanol | 2.483% |
| Perfume | 0.61% |
| N4 Amine (N,N'-Bis(3-aminopropyl)ethylenediamine) | 0.04% |
| Merquat 100 (11.9% active polymer solution made according to Example I) | 25.316% |
| Thixcin ® (organic derivative of castor oil, available from Elementis) | 0.15% |
| Water | to 100% |

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising a. a structured phase, said structured phase comprising primary particles comprising cationic polymer and anionic surfactant, wherein from about 50% to about 100% of said primary particles have a particle size of from about 2 μm to about 10 μm; and b. from 0.001% to 1.0% of a structurant;

wherein said cationic polymer is selected from poly(diallyldimethylammonium chloride-co-acrylic acid), poly (diallyldimethyl ammonium chloride), terpolymer of dimethylamine-epichlorohydrin-ethylenediamine, poly (acrylamide-methacrylamidopropyltrimethyl ammonium chloride), poly(acrylamide-co-N,N-dimethyl aminoethyl acrylate) and its quaternized derivatives, poly (acrylamide-co-methacryloyloxyethyltrimethyl ammonium methylsulfate), or mixtures thereof;

wherein said anionic surfactant is selected from linear alkyl benzene sulfonate, alkyl ethoxylate sulfate, or mixtures thereof;

and wherein said structurant is a hydrogenated castor oil.

2. A composition according to claim 1, wherein said composition comprises from about 0.005% to about 30% by weight of said cationic polymer.

3. A composition according to claim 1 wherein said cationic polymer comprises poly(diallyldimethylammonium chloride-co-acrylic acid).

4. A composition according to claim 1, wherein said cationic polymer has a charge density of from about 0.05 to about 25 meq/g as measured at a pH of 7.

5. A composition according to claim 1, wherein said cationic polymer has a weight average molecular weight of from about 500 to about 10,000,000 Daltons.

6. A composition according to claim 1, wherein said cationic polymer has a weight-average molecular weight 500 Daltons to about 37,500 Daltons and a charge density from about 0.1 to about 12 meq/g.

7. A composition according to claim 1, wherein said anionic surfactant comprises alkyl ethoxylate sulfate.

8. A composition according to claim 1, wherein said composition comprises, by weight of said composition, from about 0.01% to about 5% nonionic surfactant.

9. A composition according to claim 1, wherein said composition comprises, by weight of said composition, from about 0.01% to about 5% linear alkyl benzene sulfonate.

10. A composition according to claim 1, wherein said HLB of said anionic surfactant is from about 7 to about 11.

11. A composition according to claim 1, wherein said composition comprises an ACD:CCD ratio, based on said anionic surfactant and cationic polymer in said composition, of from about from about 100 to about 0.01.

12. A composition according to claim 1, wherein said composition comprises an organosilicone.

13. A composition according to claim 12 wherein said organosilicone is selected from the group consisting of aminosilicone, silicone polyether, silicone urethane, and combinations thereof.

14. A composition according to claim 1, wherein said composition has a pouring viscosity of from about 10 to about 20,000 centipoises at 20/sec.

15. A composition according to claim 1 wherein said composition has a resting viscosity of from about 10,000 to about 225,000 cps at 0.05/s.

16. A composition according to claim 1 having a G' of from about 0.5 Pa to about 50,000 Pa as determined from a strain sweep at 3.142 rad/sec, and a G" of from about 0.5 Pa to about 50,000 Pa, as determined from a strain sweep at 3.142 rad/sec.

17. A composition according to claim 1, wherein said primary particles have a refractive index on a fiber of from about 1.33 to about 1.6.

18. A composition according to claim 1, wherein said composition, under wash conditions comprises a particle size of from about 0.005 μm to about 1000 μm.

19. A composition according to claim 1, wherein said composition under wash conditions, comprises a coacervate having an elastic and viscous modulus of from about 10 to about 1,000,000 Pa as measured using the Test Methods.

* * * * *